US005630306A

United States Patent [19]

Wylie

[11] Patent Number: 5,630,306

[45] Date of Patent: May 20, 1997

[54] INSULATING SPACER FOR CREATING A THERMALLY INSULATING BRIDGE

[75] Inventor: Douglas H. Wylie, Waterdown, Canada

[73] Assignee: Bay Mills Limited, Weston, Canada

[21] Appl. No.: 589,633

[22] Filed: Jan. 22, 1996

[51] Int. Cl.[6] ..... E04C 2/54

[52] U.S. Cl. ..... 52/786.13; 52/171.3; 52/730.4; 52/734.2; 52/309.1; 52/745.19; 29/897.3; 29/897.31

[58] Field of Search ..... 52/786.13, 730.4, 52/734.2, 171.3, 741.4, 745.19, 309.1; 29/897.3, 897.31

[56] References Cited

U.S. PATENT DOCUMENTS

| | | | |
|---|---|---|---|
| 2,303,897 | 12/1942 | Smith . | |
| 3,030,673 | 4/1962 | London . | |
| 3,068,136 | 12/1962 | Reid . | |
| 3,226,903 | 1/1966 | Lillethun . | |
| 3,981,111 | 9/1976 | Berthagen . | |
| 3,994,109 | 11/1976 | Pandell . | |
| 4,057,945 | 11/1977 | Kessler . | |
| 4,080,482 | 3/1978 | Lacombe . | |
| 4,113,905 | 9/1978 | Kessler . | |
| 4,222,209 | 9/1980 | Peterson . | |
| 4,222,213 | 9/1980 | Kessler . | |
| 4,261,145 | 4/1981 | Brocking . | |
| 4,322,926 | 4/1982 | Wolflingseder et al. . | |
| 4,411,115 | 10/1983 | Marzouki et al. . | |
| 4,455,796 | 6/1984 | Schoofs . | |
| 4,468,905 | 9/1984 | Cribben . | |
| 4,479,988 | 10/1984 | Dawson . | |
| 4,551,364 | 11/1985 | Davies . | |
| 4,564,540 | 1/1986 | Davies et al. . | |
| 4,651,482 | 3/1987 | Borys . | |
| 4,652,472 | 3/1987 | Davies . | |
| 4,658,553 | 4/1987 | Shinagawa . | |
| 4,719,728 | 1/1988 | Eriksson et al. . | |
| 4,850,175 | 7/1989 | Berdan . | |
| 5,094,055 | 3/1992 | Berdan . | |
| 5,125,195 | 6/1992 | Brede | 52/171.3 |
| 5,313,762 | 5/1994 | Guillemet . | |
| 5,377,473 | 1/1995 | Narayan et al. | 52/786.13 |
| 5,439,716 | 8/1995 | Larsen . | |
| 5,461,840 | 10/1995 | Taylor . | |
| 5,466,534 | 11/1995 | Newby . | |
| 5,485,709 | 1/1996 | Guillemet . | |

*Primary Examiner*—Christopher T. Kent

*Attorney, Agent, or Firm*—Fitzpatrick, Cella, Harper & Scinto

[57] ABSTRACT

An insulating spacer for creating a thermally insulating bridge between inner and outer panes of, for example, a multiple pane window unit. The spacer defines an insulated space between the panes and includes a top bridge member, first and second metallic leg members, a bottom bridge member and a channel portion. The top bridge member is provided for contacting the inner and outer panes of the window unit. The top bridge member is made of a synthetic resin or composite material and can include openings. Perforated extensions of the first and second leg members are secured to the top bridge member. The first and second leg members can be bent into a zig-zag configuration. The bottom bridge member is substantially parallel to the top bridge member and cooperates with the first and second leg members. The channel portion is defined by the configuration of the top bridge member, the first and second leg members and the bottom bridge member. In one embodiment, the bottom bridge member is roll-formed from the same piece of metal as the first and second leg members. In another embodiment, the bottom bridge member is formed from a material similar to, or the same as, that of the top bridge member. Methods of making such an insulating spacer also are disclosed.

26 Claims, 5 Drawing Sheets

INSULATING SPACER FOR CREATING A THERMALLY INSULATING BRIDGE

BACKGROUND OF THE INVENTION

1. Field of the Invention

This invention generally relates to an insulating spacer and in particular to an insulating spacer for creating a thermally insulating bridge between spaced-apart panes in a multiple glass window unit, for example, to improve the thermal insulation performance of the unit. This invention also relates to methods of making such an insulating spacer.

2. Description of the Related Art

An important consideration in the construction of buildings is energy conservation. In view of the extensive use of glass in such construction, a particular problem is heat loss through glass surfaces. One solution to this problem has been an increased use of insulating glass units comprising basically two or more glass panels separated by a sealed dry air space. Sealed insulating glass units generally require some means of precisely separating the glass panels, such as by spacers.

The spacers currently used are generally tubular channels made entirely of steel, aluminum or some other metal containing a desiccant to adsorb moisture from the space between the glass panels to thus avoid condensation problems and to keep the sealed air space dry. Tubular spacers are commonly roll-formed into the desired profile shape. Steel spacers are generally cheaper and stronger, but aluminum spacers are easier to cut and install. Aluminum also provides lightweight structural integrity, but it is expensive and tends to be a poor thermal performer. Spacers made entirely of plastic also have been used to a limited extent. However, plastic is permeable, which can result in moisture transmission and condensation.

There are certain significant factors that influence the suitability of the spacer, particularly the heat conducting properties and the coefficient of expansion of the material. Since a metal spacer is a much better heat conductor than the surrounding air space, its use leads to the conduction of heat between the inside glass pane and the outside glass pane resulting in heat dissipation, energy loss, moisture condensation, especially on the sill, and other problems. Further, the coefficient of expansion of commonly used spacer materials is much higher than that of glass. Thus, heat conduction results in a differential dimensional change between the glass and the spacer, thereby causing stresses to develop in the glass and in the seal. This can result in damage to and failure of the sealed glass unit, such as by sufficient lengthwise shrinkage of the spacer to cause it to pull away from the sealant.

The most common material commercially used in the manufacture of such spacer units has been metal. Metal has been used because it has a coefficient of expansion similar to that of glass, among other reasons, and because this property is important in the manufacture of such a unit. Any difference in thermal expansion causes problems. This is particularly true in climates that have large changes in temperature. These consequences include cracking of the glass and at least breaking of the seal between the panes of glass.

Some experimentation has been made with all-plastic spacers, particularly nylon, vinyl, polyvinyl chloride, polycarbonate or other extruded plastic spacers, but these units generally have been thin and structurally weak. In fact, these thin, non-metal spacers can bend undesirably and collapse.

Furthermore, to date, most thermoplastics have been unacceptable for use as spacers because they give off volatile materials, e.g., plasticizers, which can cloud or fog the interior glass surface. In view of the above-noted drawbacks, such all-plastic spacers generally have been found unsatisfactory.

Therefore, metal has been the generally accepted material even though this material has a number of disadvantages. In particular, the thermal conductivity of metal is considerably higher than that of glass or of the air space between the panes of glass. In a sealed unit, heat from within a building tries to escape in winter, and it takes the path of least resistance. The path of least resistance is around the perimeter of a sealed window unit, where the metal spacer strip is provided. Metal spacers contacting the inner and outer panes of glass act as conductors between the panes and provide an easy path for the transmission of heat from the inside glass panel to the outside panel. As a result, under low temperature conditions in winter, and when the seal fails, for instance, condensation of moisture can occur inside the insulating glass or on the surfaces of the inner glass panel. Also, heat is rapidly lost from around the perimeter of the window, often causing a ten to twenty degree Fahrenheit temperature drop at the perimeter of the window relative to the center thereof. Under extreme conditions in winter, a frost line can occur around the perimeter of the window unit.

The above-noted temperature differential also results in differential shrinkage between the center of the glass pane and the perimeter. Then, stress cracks can develop in the glass or the seal can be broken. When the outside seal breaks down, air can enter the space between the windows carrying water vapor which is deposited inside the panes. Condensation of this moisture causes fogging of the window unit. Many window units tend to fail due to such stress cracks or loss of seal.

Another problem inherent in previous spacer arrangements is that a rigid spacer provides an excellent path for the transmission of sound from the outer panel to the inside panel. This poses a particular problem in high-noise areas such as airports. Other institutions such as hospitals also have a need for low sound transmission glass units.

A still further problem with conventional glass units is related to deflection of the panels under the influence of high winds, traffic noise, or internal pressure changes owing to expansion or contraction of the air mass contained within the glass unit. This action imposes high stresses on the glass panels and can break the seal between the spacer and the glass thus allowing moisture to enter. In extreme cases, the glass panels can break.

The prior art has attempted to overcome the drawbacks noted above by providing composite spacers. For instance, U.S. Pat. No. 4,113,905 discloses a composite foam spacer for separation of double insulated glass panes. The spacer includes a thin extruded metal or plastic core and a relatively thick foam plastic layer cast to the core.

In order to make such a spacer, a thin extruded or roll-formed core is supported in an elongated two-piece casting mold by a support rod. Curable foam plastic is cast into the annular space formed between the core and the mold. The foam is then cured and allowed to cool so that it shrinks to form a 25 to 150 mil thick layer around the core. The core itself is very thin, on the order of ten mils, and is made of an extruded or roll-formed material, either metal such as aluminum or steel, or some type of extrudable plastic such as PVC or phenylene oxide polymer. The foam casting material is a foam-in-place phenolic, polyester or polyurethane resin.

Such a spacer provides advantages due to the structural rigidity provided by the metal base. However, the spacer suffers from disadvantages in that the relatively thin coating of foam material may not serve as a thermally insulating bridge over the continuous metal tube. Further, such a spacer can be expensive to manufacture, because conventional injection molding techniques can be impractical to make such a thin hollow elongated body. In addition, vinyl spacers are generally poor sealants and are subject to mechanical failure.

U.S. Pat. No. 4,222,213 is an improvement over the spacer taught in the '905 patent. The spacer in the '213 patent includes a thin plastic insulating shape which is extruded and thereafter fitted by contact pressure or friction, over a portion of a conventional extruded or roll-formed metal spacer and has projecting contacts which abut the glass panes. The plastic insulating overlay can be formed over a conventional extruded aluminum spacer and from an extrudable thermoplastic resin. However, the force fit and the bimaterial construction of such a spacer can result in separation of the two components with changes in temperature due to the different thermal expansion coefficients of the metal and the plastic. This is undesirable.

Accordingly, a need has arisen to provide an insulating spacer which creates a thermally insulating bridge between spaced-apart panes in a multiple glass unit and which overcomes the above-noted drawbacks with conventional insulating spacers and those associated with conventional spacer manufacturing techniques.

SUMMARY OF THE INVENTION

It is an object of the present invention to provide an improved thermally insulating spacer for a multiple glass unit which solves or overcomes the drawbacks noted above with respect to conventional and other insulated spacers. In this regard, the present invention also can be a replacement for conventional aluminum spacers, for example.

It is another object of the present invention to provide an improved method of manufacturing such an improved composite insulating spacer to provide an improved and satisfactory bonding between the metal and plastic materials in such a composite spacer.

It is another object of this invention to create a thermally insulating bridge to reduce heat transfer from one pane of glass to another through the insulating spacer of the present invention. This invention thus keeps the inner pane of glass several degrees warmer than it might otherwise be in the winter, while preventing condensation that otherwise may occur.

It is yet another object of the present invention to provide an insulating spacer with a coefficient of expansion approximately equal to that of glass.

It is still another object of the present invention to improve thermal insulation, particularly in buildings, and to provide for improved multiple insulated glass.

These and other objects that will become apparent may be better understood by the detailed description provided below.

The present invention provides an insulating spacer for spacing apart panes of a multiple pane window unit, for example, and for defining an insulated space between the panes. The insulating spacer includes a top bridge member, a metallic first leg member and a metallic second leg member, a bottom bridge member and a channel portion defined by a configuration of the top bridge member, the first and second leg members and the bottom bridge member. The top bridge member is made from a synthetic resin material or composites thereof, and is provided for contacting the panes of the multiple pane unit and creating a thermally insulating bridge between the panes. The top bridge member has an upper surface and a lower surface substantially parallel to the upper surface, and can include openings. The first and second leg members have extensions on one or both ends thereof, and the extensions are perforated. The leg members are secured to the lower surface of the top bridge member by the perforated extensions on one end thereof. In one aspect, portions of the top bridge member pass through the perforations in the extensions of the leg members, to secure the leg members to the top bridge member. The first and second leg members can be bent into a zig-zag configuration. The bottom bridge member is substantially parallel to the top bridge member.

The channel portion can contain desiccant material for adsorbing moisture from the space between the window panes through the openings in the top bridge member. In one embodiment, the bottom bridge member is roll-formed from the same piece of material as the first and second leg members. In another embodiment, the bottom bridge member is formed from a synthetic resin or composite material the same as, or similar to, that of the top bridge member. In this instance, the first and second leg members have extensions on both ends thereof. Portions of the bottom bridge member pass through the perforations in these extensions, to secure the leg members to the bottom bridge member.

The present invention can be customized to a particular installation or to a customer's demand by extruding the outer sides of the top bridge member to the finished dimensions and by bending the first and second leg members to the desired dimensions. The first and second leg members provide structural rigidity and intended bendability in fabrication and allow the spacer to conform to and retain varying dimensions.

The present invention improves the thermal performance of the insulated glass units along the edge of the assembly.

The present invention also provides methods of making the insulating spacer of the present invention. One method includes the steps of: forming metal into first and second leg members, the first and second leg members having extensions on one end thereof, and the extensions of the first and second leg members being perforated, preheating the leg members near or above the melting point of a synthetic resin or composite material, forcing together the extensions of the first and second leg members of the channel and the one of the synthetic resin material and the composite synthetic resin material, to secure the extensions of the leg members to the material such that the material forms a first bridge member across the leg members, and defining a channel portion of an insulating spacer by the configuration of the first bridge member, the first and second leg members and a second bridge member. In one aspect, portions of the top bridge member pass through the perforations in the extensions of the leg members, to secure the leg members to the top bridge member. The present invention also includes other ways to secure the first and second leg members to the top bridge member, such as by cross head extrusion of the top bridge member, adhesive or otherwise bonding the elements together, or by ultrasonic vibration or heating. The first and second leg members can be bent into a desired configuration. The desired configuration can be zig-zag.

The second bridge member can either be roll-formed from the same piece of material as the first and second leg members, or the second bridge member can be formed from a synthetic resin or composite material the same as, or similar to, that of the first bridge member. In the latter case, the leg members can be provided with perforated extensions on each end thereof. In that case, the leg members are preheated, and the extensions of the first and second leg members are forced together with synthetic resin or composite synthetic resin, to secure the extensions of the leg members to the material such that the material forms first and second bridge members across the leg members.

A better understanding of these and other advantages of the present invention, as well as objects attained for its use, may be had by reference to the drawings and to the accompanying description, in which there are illustrated and described preferred embodiments of the invention.

BRIEF DESCRIPTION OF THE DRAWINGS

Throughout the views, like or similar reference numerals have been used for like or corresponding parts.

DESCRIPTION OF THE PREFERRED EMBODIMENTS

The insulating spacer of the present invention is designed as a double seal insulating spacer for spacing apart panes of, for example, a double glass window unit (not shown) and for defining an insulated space between the panes. For ease of discussion, reference is made herein to double pane glass window units. However, the present invention can be utilized with multiple pane units, and is not limited to window units made from glass, or even to window units. Rather, the present invention can be used with units made from plastic and other materials, and to doors, display cases and like applications where insulating spacers are required.

The insulating spacer and methods of making same of the present invention are improvements over those disclosed in commonly assigned U.S. Pat. No. 5,313,762 and commonly assigned [copending application No. 08/189,145, filed Jan. 31, 1994, which will issue as] U.S. Pat. No. 5,485,709 [on Jan. 23, 1996,] the disclosures of each of which are incorporated herein by reference.

Figure 1A:
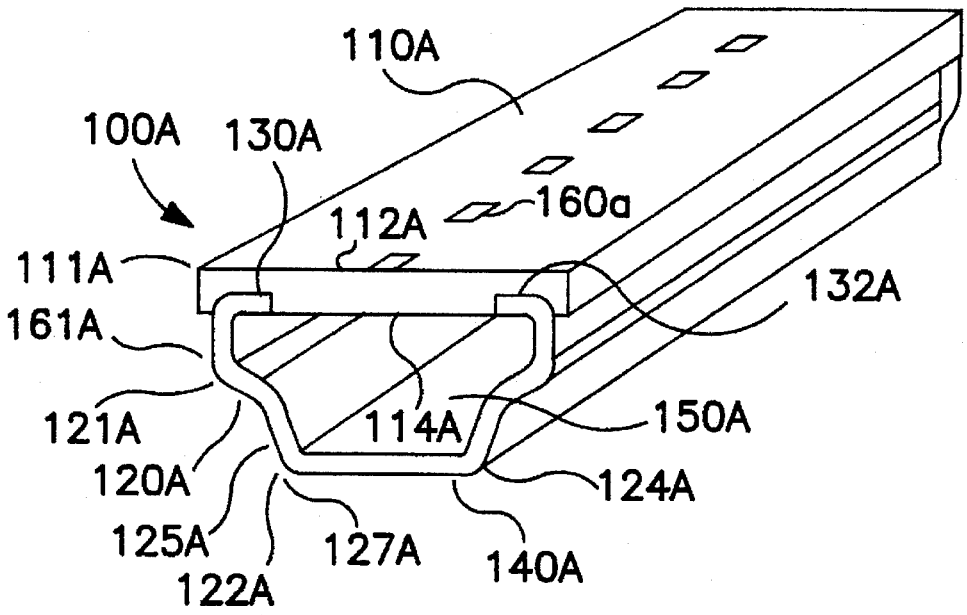
FIGS. 1A and 1B are perspective views of alternate first embodiments of a double seal insulating spacer of the present invention.

Referring now to FIG. 1A, a first embodiment of a double seal insulating spacer of the present invention is designated by reference numeral 100A.

The spacer 100A includes a top bridge member 110A for contacting the inner and outer window panes of a double pane window unit, for instance.

In this embodiment and in each of the embodiments discussed below, the top bridge member is made of synthetic resin materials capable of providing the desired physical characteristics and capable of withstanding ultraviolet light without fading or discoloring, such as polyethylene terephthalate resins, polycarbonate resins or other suitable synthetic resins, or from composites thereof including those of glass fibers or beads, for example. In the preferred embodiments, PETG available from Eastman or BASF is used. For example, it is preferred to use poly(ethylene-1,4-cyclohexylenedimethylene terephthalate), available from Eastman under the tradename Kodar PETG copolyester 6763, which is an amorphous (noncrystalline) thermoplastic polyester of the PET [poly(ethylene terephthalate)] family. The "G" in the Kodar PETG copolyester designation indicates the use of a second glycol(1,4-cyclohexanedimethanol, or CHDM) in making the polymer. The addition of this glycol results in a copolyester that can be readily extruded.

One having ordinary skill in the art recognizes that other synthetic resin materials or composites providing the desired properties can be used. However, it has been found that the use of polyvinyl chloride (PVC) is not preferred. Rather, PVC tends to emit or generate chlorine gases that can corrode the low E coating on glass. Further, PVC can cause fogging on the window panes, which arises from a phenomenon known as "out-gassing."

The top bridge member 110A is of unitary construction and includes an upper surface 112A and a lower surface 114A substantially parallel to the upper surface 112A. The top bridge member 110A can include openings 160A.

In this embodiment and in the embodiments discussed below, top bridge member 110A can be provided with a cavity, recess or trough portion to receive, for example, a frame to hold a decorative panel, to provide a triple pane arrangement. Also, top bridge member 110A can be punched or drilled, for example, to receive muntins or other decorative features.

Channel member 120A includes first and second legs 122A and 124A, respectively. In this embodiment and in each of the embodiments discussed below, the first and second legs of the channel member 120A can be made of metal selected from the group consisting of stainless steel, galvanized steel, tin plated steel and aluminum, including composites thereof. Although stainless or galvanized steel is preferred, other metals can be used if desired.

As will be discussed in more detail below, first leg 122A and second leg 124A are secured to the top bridge member 110A. In this embodiment, as shown, first leg 122A includes an extension 130A, while second leg 124A includes an extension 132A. Extensions 130A and 132A are "inwardly extending" towards the center of spacer 100A. This is preferred, since the perforations thereof, discussed below, are contained "within" the spacer. Extensions 130A and 132A, penetrating top bridge member 100A approximately one to two times their thickness, improve the structural properties of the spacer 110A. While extensions 130A and 132A have been shown as generally being inwardly extending and L-shaped, the extensions can extend outwardly and can be of other shapes. One having ordinary skill in the art also recognizes that other configurations are within the concepts of the present invention.

In this and in the embodiments discussed below, the first leg 122A and second leg 124A can be arranged flush with top bridge member 110A, rather than being recessed therefrom. Such an arrangement may be desired in warmer installations where large temperature gradients are not a factor.

Figure 4:
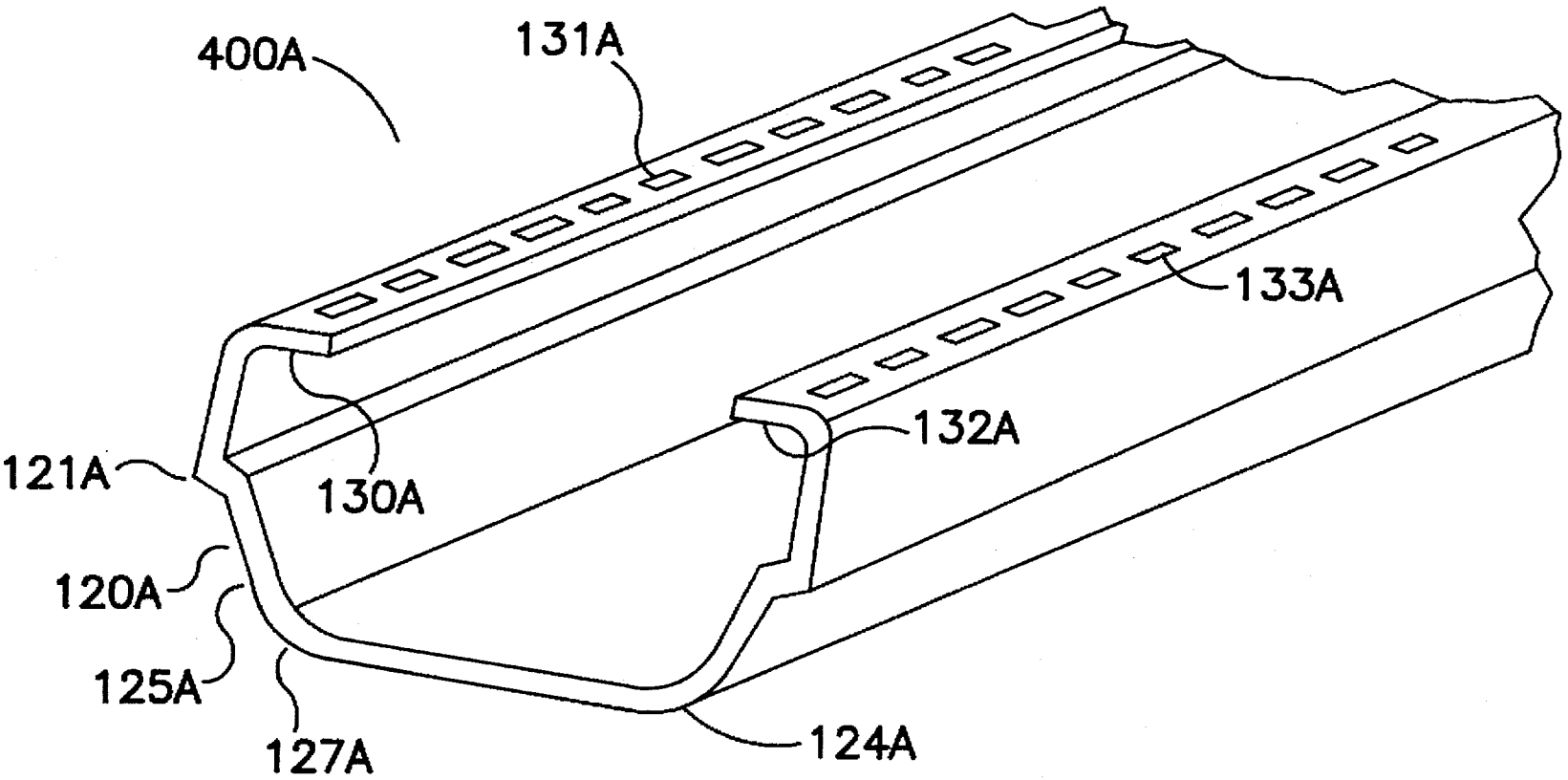
FIG. 4 shows an insulating spacer channel for use in the present invention.

To secure the first leg 122A and second leg 124A to the top bridge member 110A, extension 130A of first leg 122A includes perforations 131A, while extension 132A of second leg 124A includes perforations 133A (the perforations are best seen in FIG. 4). In fabrication, as will be discussed below, the first (122A) and second (124A) leg members are preheated to near or above the melting point of the material of the top bridge member 110A, and the extensions 130A and 132A of the first (122A) and second (124A) leg members are forced together with the material for the top bridge member 110A, to secure the extensions of the leg members to the material such that the material forms the top bridge member 110A across the first leg 122A and second leg 124A. Of course, other techniques can be used to secure these elements together. Portions of the material of the top bridge member 110A pass through the perforations 131A and 133A of the extensions of the first and second legs 122A and 124A. I have found that these portions of the material passing through the perforations have a tendency to "grab" or "bite into" the metal on the other side, to assist in securing the elements together. In fact, the material passing through the perforations forms a mushroom-shaped rivet on the other side of the spacer. The extensions of the first leg 122A and second leg 124A penetrate the top bridge member 110A to a depth approximately one to two times their thickness.

Accordingly, The extensions of each of the first leg 122A and second leg 124A aid in affixing the two materials together. These extensions also can aid in the bendability of the final product, because the extensions of the first and second leg members are firmly secured to the top bridge member 110A.

Also included is a bottom bridge member 140A, which is substantially parallel to the top bridge member 110A. In this embodiment, the bottom bridge member 140A is roll-formed from the same piece of material as the first and second legs of the channel member 120A. This design provides a simple construction. Channel portion 150A is defined by the configuration of the top bridge member 110A, the first and second legs of the channel member 120A and the bottom bridge member 140A.

In this embodiment, as in each of the embodiments discussed below, the channel portion 150A can contain a desiccant material (not shown) for adsorbing moisture from the space between the window panes through the openings 160A in the top bridge member 110A. Desiccants, known in the art, may include zeolytes, silica gels other moisture adsorbing materials. Accordingly, openings 160A are large enough to allow vapor adsorption, but are small enough to confine any desiccant material (not shown) which can be contained within channel portion 150A.

If desired, in this embodiment and in the embodiments discussed below, the top bridge member 110A can be extruded to the desired dimensions. Generally, the top bridge member 110A is about 0.250 to about 0.875 inches in overall width and about 0.045 inches in height. The bottom bridge member 140A is narrower than the top bridge member. The channel member 120A also is narrower than the top bridge member 110A, to maintain the metal away from the glass. The overall height of the insulating spacer 100A is on the order of about 0.300 inches. Of course, in this embodiment and in the ones discussed below, dimensions other than those discussed can be utilized, as installation requires. Therefore, the present invention is not limited to the dimensions discussed herein.

In this embodiment and in each of the embodiments discussed below, the channel member 120A can be bent to desired dimensions. The first and second leg members provide structural rigidity and intended bendability in fabrication and allow the spacer 100A to conform to and retain varying dimensions. In each case, it is preferred that the outermost dimension of the insulating spacer 100A, provided by the synthetic resin or composite material bridge member, and no metal, contacts the inner and outer panes of the window unit. This significantly reduces the heat transfer between the panes. In turn, condensation is prevented by the reduced temperature differential. Of course, as discussed above, the leg members can be arranged flush to the top bridge member, if desired.

If desired, in this embodiment and in the embodiments discussed below, the top bridge member (110A) can be trapezoidal in shape, being truncated at about a 45° angle on each side, so that a reduced dimension, on the order of about 0.015 inches, contacts the inner and outer panes. This minimized surface area contact even further reduces the heat transfer between the panes.

Spacer 100A is a double seal insulating spacer. A first sealant (not shown), such as polyisobutylene or an equivalent, can be applied by known techniques on either side of spacer 100A into cavity 161A defined by edge IIIA of top bridge member 110A and bend 121A of channel member 120A, for example. If desired, a second sealant (not shown), such as polysulfide or polyurethane, can be applied by known techniques on either side of spacer 100A into cavity 125A defined by bend 121A and bend 127A of channel member 120A, for example.

Figure 1B:
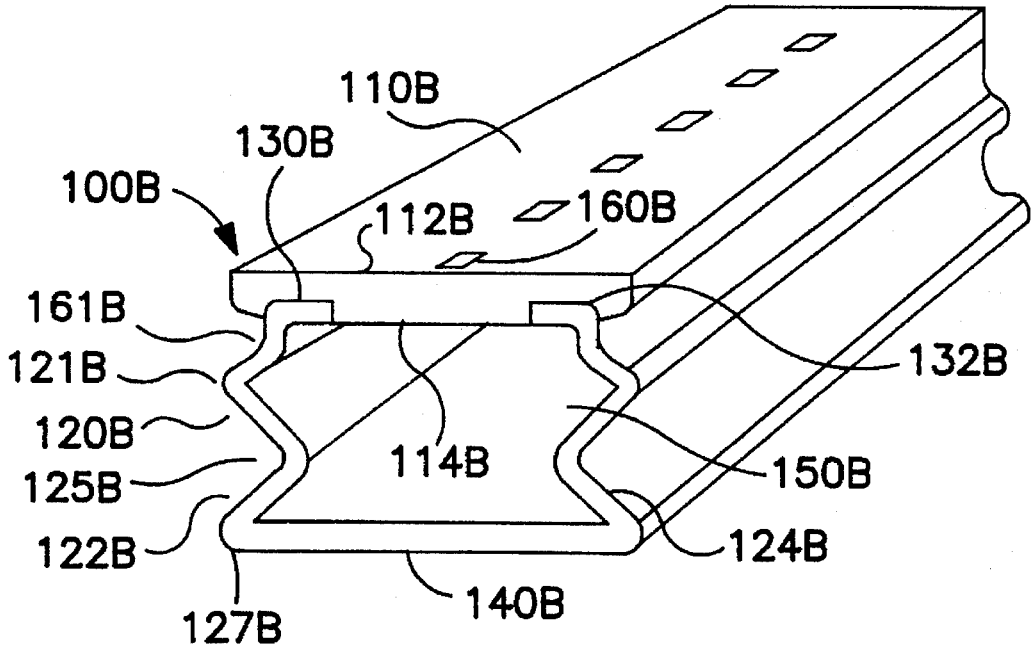

Referring now to FIG. 1B, an alternative of the first embodiment of the insulating spacer of the present invention is designated by reference numeral 100B. Like parts in this alternative embodiment are designated by reference numerals similar to those in the first embodiment, modified by the suffix letter.

Spacer 100B includes a top bridge member 110B for contacting the inner and outer panes of a double pane window unit, for instance. As discussed above, top bridge member 110B is made of a synthetic resin or composite material. The top bridge member 110B is of unitary construction and includes an upper surface 112B and a lower surface 114B substantially parallel to the upper surface 112B. The top bridge member 110B can include openings 160B.

Channel member 120B includes first and second legs 122B and 124B, respectively. In this alternative of the first embodiment and in each of the alternative embodiments discussed below, first leg 122B and the second leg 124B are each bent into a zig-zag configuration. However, in these alternative embodiments, bend configurations other than zig-zag can be utilized. The zig-zag configuration of the channel member 120B provides advantages in fabrication of the spacer, allowing the channel member 120B to be readily bent to desired dimensions.

Perforated extension 130B of first leg 122B and perforated extension 132B of second leg 124B are secured to the top bridge member 110B in the manner discussed above with respect to FIG. 1A (and FIG. 4). Also, as discussed above, these extensions can extend inwardly or outwardly.

Also included is a bottom bridge member 140B, which is substantially parallel to the top bridge member 110B. In this embodiment, the bottom bridge member 140B is roll-formed from the same piece of material as the first and second legs of the channel member 120B. The overall arrangement defines channel portion 150B.

Spacer 100B also is a double seal insulating spacer. A first sealant (not shown), such as polyisobutylene or an equivalent, can be applied into cavity portion 161B and if desired, a second sealant (not shown), such as polysulfide or polyurethane, can be applied into cavity portion 125B.

Figure 2A:
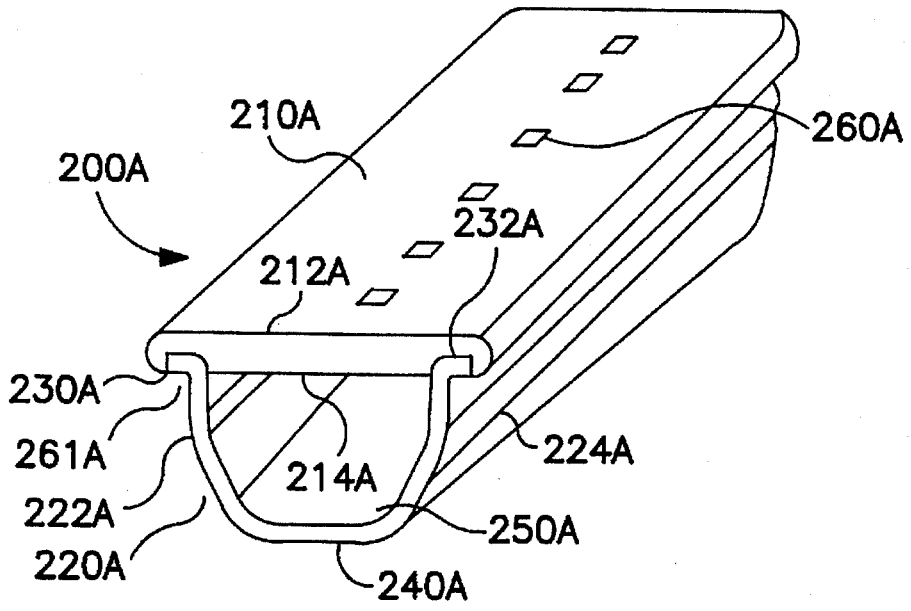
FIGS. 2A and 2B are perspective views of alternate second embodiments of a single seal insulating spacer of the present invention.

Referring now to FIG. 2A, a second embodiment of the insulating spacer of the present invention is designated by reference numeral 200A.

Spacer 200A is designed as a single seal insulating spacer. A single sealant such as polysulfide or polyurethane (not shown), can be applied into cavity 261A beneath top bridge member 210A.

Top bridge member 210A contacts the inner and outer window panes of a double glass window unit, for instance. The top bridge member 210A is made of a synthetic resin or composite material. The top bridge member 210A includes an upper surface 212A and a lower surface 214A substantially parallel to the upper surface 212A. The top bridge member 210A can include openings 260A.

Channel member 220A includes first and second legs 222A and 224A, respectively. Perforated extension 230A of first leg 222A and perforated extension 232A of second leg 224A are secured to the top bridge member 210A in the manner discussed above with respect to the alternative first embodiments. Extensions 230A and 232A extend outwardly.

Bottom bridge member 240A is substantially parallel to the top bridge member 210A. In this embodiment, the bottom bridge member 240A is roll-formed from the same piece of material as the first and second legs of the metal channel member 220A. The overall arrangement defines channel portion 250A.

Figure 2B:
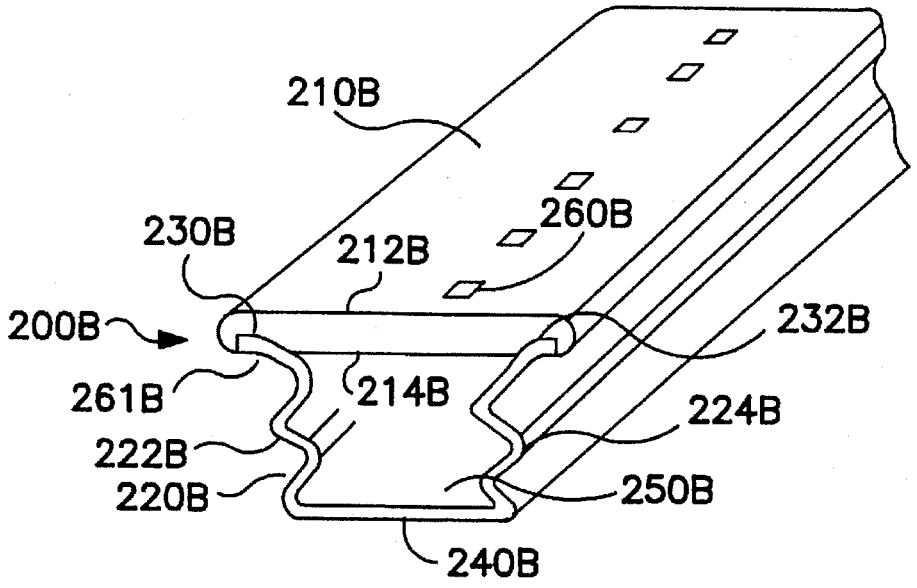

Referring now to FIG. 2B, an alternative of the second embodiment of the insulating spacer of the present invention is designated by reference numeral 200B.

Spacer 200B is designed as a single seal insulating spacer. A sealant such as polysulfide or polyurethane (not shown), can be applied into cavity 261B beneath top bridge member 210B.

Top bridge member 210B contacts the panes of a double glass window unit, for instance. The top bridge member 210B is made of a synthetic resin or composite material, and includes an upper surface 212B and a lower surface 214B substantially parallel to the upper surface 212B. The top bridge member 210B can include openings 260B.

Channel member 220B includes first and second legs 222B and 224B, respectively. In this embodiment, first leg 222B and the second leg 224B are each bent into a zig-zag configuration. Perforated extension 230B of first leg 222B and perforated extension 232B of second leg 224B are secured to the top bridge member 210A in the manner discussed above with respect to the alternative first embodiment. Extensions 230B and 232B extend outwardly.

Bottom member 240B is substantially parallel to the top bridge member 210B. In this embodiment, the bottom bridge member 240B is roll-formed from the same piece of material as the first and second legs of the metal channel member 220B. The overall arrangement defines channel portion 250B.

Figure 3A:
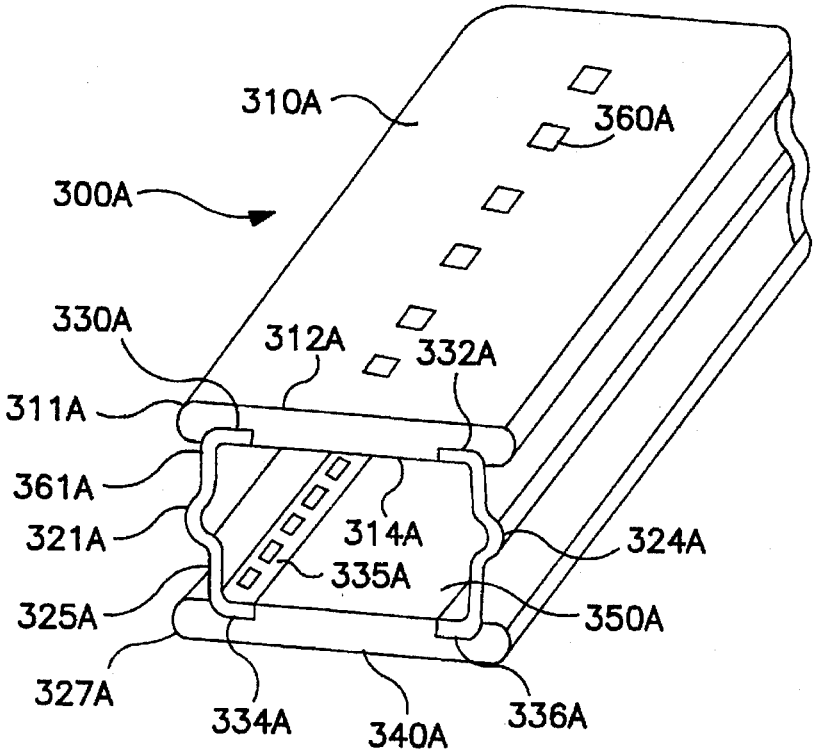
FIGS. 3A and 3B are perspective views of alternate third embodiments of a double seal insulating spacer of the present invention.

Referring now to FIG. 3A, a third embodiment of the insulating spacer of the present invention is designated by reference numeral 300A.

Spacer 300A is designed as a double seal insulating spacer and includes a top bridge member 310A for contacting the panes of a double glass window unit, for instance. The top bridge member 310A is comparable to the top bridge member 110A of the first embodiment.

Channel member 320A includes first and second legs 322A and 324A, respectively. Perforated upper extension 330A of first leg 322A and perforated upper extension 332A of second leg 324A are secured to the top bridge member 310A in the manner discussed above. These extensions extend inwardly.

Bottom bridge member 340A is substantially parallel to the top bridge member 310A. In this embodiment, the bottom bridge member 340A is made of a synthetic resin or composite material similar to, or the same as, that of the top bridge member 310A. Lower extension 330A of first leg 322A includes perforations 335A and lower extension 332A of second leg 324A likewise includes perforations. These perforated extensions are secured to the bottom bridge member 340A in the manner discussed above with respect to the top bridge members of this and the previous embodiments. The overall arrangement defines channel portion 350A.

Spacer 300A is a double seal insulating spacer and includes cavity 361A defined by edge 311A of the top bridge member 310A and bend 321A of channel member 320A for a first sealant, and cavity 325A defined by bend 321A and edge 327A of channel member 320A for a second sealant.

Figure 3B:
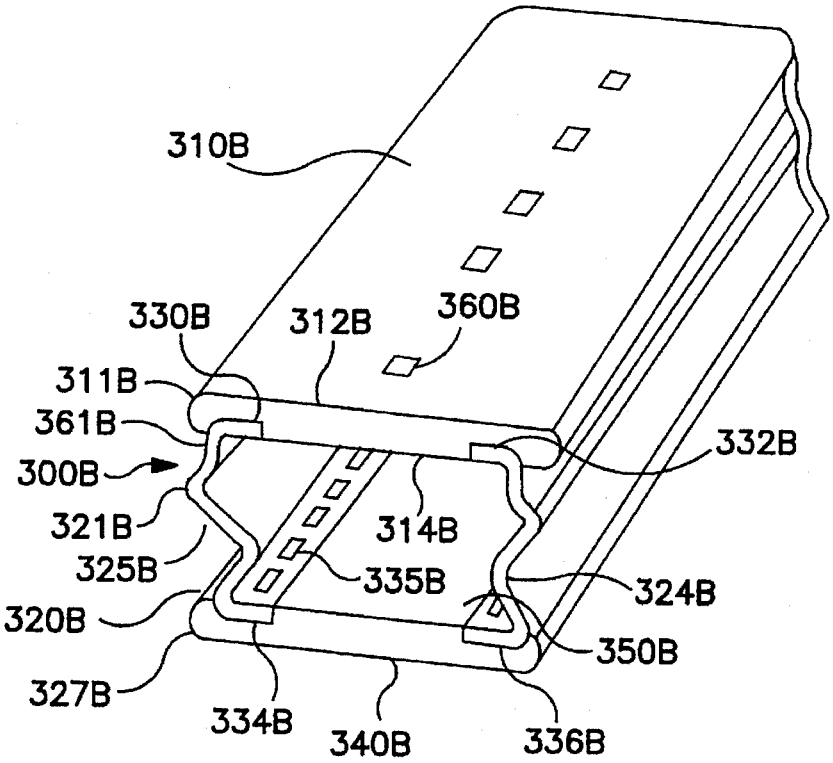

Referring now to FIG. 3B, an alternative of the third embodiment of the insulating spacer of the present invention is designated by reference numeral 300B.

Spacer 300B, including cavity 361B for a first sealant and cavity 325B for a second sealant, is designed as a double seal insulating spacer and includes a top bridge member 310B for contacting the inner and outer window panes of a double glass window unit. The top bridge member 310B is comparable to the top bridge member 110B of the alternative of the first embodiment.

Channel member 320B includes first and second legs 322B and 324B, respectively. Perforated upper extension 330B of first leg 322B and perforated upper extension 332B of second leg 324B are secured to the top bridge member 310B in the manner discussed above with respect to the previous embodiments. The first leg 322B and the second leg 324B are each bent into a zig-zag configuration.

Bottom bridge member 340B is substantially parallel to the top bridge member 310B. In this embodiment, the bottom bridge member 340B is made of a synthetic resin or composite material similar to, or the same as, that of the top bridge member 310B. Lower extension 334B of first leg 322B includes perforations 335B and lower extension 336B of second leg 324B likewise includes perforations. These perforated extensions are secured to the bottom bridge member 340B, in the manner discussed above with respect to FIG. 3A. The extensions extend inwardly, and the overall arrangement defines channel portion 350B.

A primary distinction between the insulating spacers 300A and 300B of the FIG. 3A and FIG. 3B embodiments and those spacers of the embodiments of FIGS. 1A and 1B and FIGS. 2A and 2B is that each of the bottom bridge members 340A and 340B is made of a synthetic resin or composite material similar to, or the same as, that of the top bridge member 310B. Thus, insulating spacers 300A and 300B substantially eliminate all heat transfer through channel member 320A and 320B by providing a complete synthetic resin or composite material bridge between the panes of glass and between the top bridge member 310A and 310B and the bottom bridge member 340A and 340B.

Properties of the synthetic resin or composite material used for the top bridge member of the first, second and third embodiments and the bottom bridge member of the third embodiment and their alternatives are that the material possesses good extrudability characteristics, provides little or no "out-gassing" (i.e., does not emit volatile materials which can cloud the glass), ideally possesses bendability, and tends to act as a moisture (vapor) barrier and is resistant to the harmful effects caused by ultraviolet rays.

The insulating spacers of the present invention can be fabricated in various manners. For example, standard plastic corner pieces can be used to assemble four spacer pieces to make an insulating spacer frame for use in an insulated glass assembly. Alternatively, a spacer can be bent at three corners, then filled with desiccant, if desired, and closed at the last corner with a corner key. As a further alternative, a spacer can be filled with desiccant, if desired, and bent at four corners and then closed by joining the remaining two ends with a connector. It is believed that the zig-zag configuration of the channel members of the alternatives of the previous embodiments assists in the bendability of these spacers, so that 90° bends can be readily formed.

FIG. 4 shows a channel member for use with the embodiment of FIG. 1A, for example. FIG. 4 shows channel member 400A in which top bridge member 110A of the embodiment of FIG. 1A has been removed to better show perforations 131A of extension 130A of first leg 122A and perforations 133A of extension 132A of second leg 124A. The remaining elements are the same as in the embodiment shown in FIG. 1A. Perforations 131A and 133A are typically a continuous series 0.035" wide by 0.090" long and spaced 0.150" center to center. Of course, these dimensions can vary. Perforations 131A and 133A can be formed in any desired manner such as by punching, drilling, etc.

Figure 5:
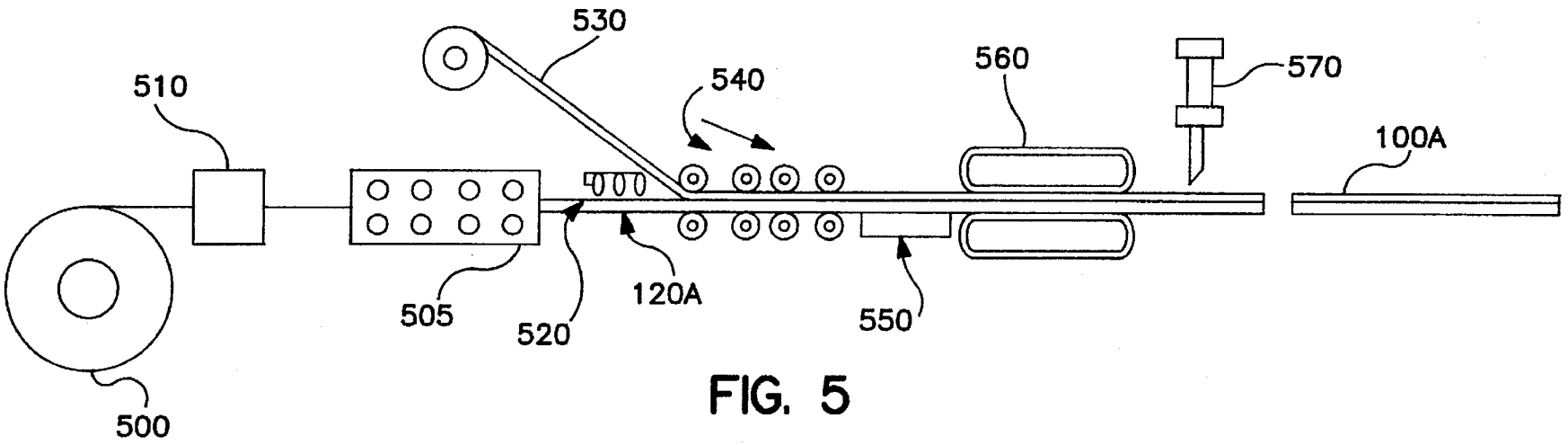
FIG. 5 is a schematic diagram of a method of making the insulating spacer of the present invention.

FIG. 5 schematically shows a method of making an insulating spacer of the present invention. Previously slit and coiled metal strip 500, of typically flash coated galvanized carbon steel or stainless steel, approximately 0.003" to 0.020" thick, with a predetermined width is uncoiled and rollformed in rollformer 505 to form channel member 120A having extensions 130A and 132A as discussed above with respect to FIG. 1A, for example. (In this discussion, the given dimensions are exemplary, and can be readily varied, as will be appreciated by one having ordinary skill in the art.) Prior to being rollformed, extensions 130A and 132A on channel member 120A are punched in a punch station 510 with a continuous series of perforations 0.035" wide by 0.090" long, spaced 0.150 center to center, for example. Although rollformer 505 and punch station 510 have been shown as being separate, these devices can be combined into one unit, if desired.

Immediately downstream of the rollformer 505 and punch station 510, the exiting channel member 120A, travelling at a fixed speed (approximately 30 to 200 feet per minute), is heated with a series of propane torches 520, for example. Currently, four direct-fired gas flame burners or torches are used, but more or less could be used which would affect line speed proportionally. Other sources of heat could be used, such as infrared, hot air, induction, or resistance heating. In fact, other techniques can be used for securing together these pieces. For example, cross head extrusion, adhesive bonding, ultrasonic welding and the like could be use to achieve the same results. In this embodiment, channel member 120A is heated to near or above the melting point of the synthetic resin material or composite synthetic resin material 530 used to form the top bridge member 110A (estimated temperature of the heated member 120A is 400 degrees Celsius).

As discussed above, other processes like ultrasonic welding, induction welding or bonding can be used to manufacture the insulating spacer of the present invention.

An ultrasonic welding process uses high frequency (e.g., above about 20,000 cycles/second) vibrations in the metal of the first and second leg members of the channel member. The metal is vibrated against the resin or composite material. The vibrations in the metal create friction which heats the resin or composite material to its melting point. Then, the first and second leg members of the channel member will embed into the resin or composite material.

In induction welding, electric current is induced to the metal of the first and second leg members of the channel member by a high radio frequency. This causes the metal to become very hot, sufficient to melt the resin or composite material thereto.

In a bonding process, previously extruded resin or composite material and treated metal of the first and second leg members of the channel member are joined together by an adhesive or other bonding agent.

A series of guiding and laminating rollers 540 is positioned immediately downstream of heating (or other securing) source 520 to apply pre-extruded synthetic resin material or composite synthetic resin material 530 to the perforated extensions 130A and 132A of heated metal channel 120A. In the preferred embodiment, the resin material 530 pre-extruded to the final dimensions is fed from spools of material mounted above the rollformer 505 and punch station 510, to mate with the metal channel 120A below. Currently, four pairs of rollers, 5" in diameter, spaced 5½" apart, are used. The rollers in each pair are positioned directly above and below each other, and are used to guide and push the resin material 530 onto perforated extensions 130A and 132A of the heated channel 120A. To contain the resin material 530, the top roller in each pair has a rectangular groove 0.005" wider, and approximately the same depth, as the thickness of the resin material 530. The bottom roller in the pair has a rectangular groove the same width as the metal channel 120A, and a depth of just less than the height of the leg members. This groove holds the width and position of channel member 120A as the resin material 530 is applied. Both grooves in the pair have the same centerline in a vertical plane which positions the resin material 530 in the center of the channel member 120A. The optimum number, spacing and diameter of the laminating rollers 540 can be determined according to processing conditions and are factors that influence production speed. Means other than rollers can be used for moving the pieces, as will be appreciated by one having ordinary skill in the art.

At the nip point of the first pair of the rollers 540, the resin material 530 is brought into physical contact with the heated metal channel 120A, which in turn melts the bottom surface of the resin material 530. Pressure from the laminating rollers 540 squeezes the molten resin material through the perforations in leg members 130A and 132A. Adjustable, fixed gaps between the roller pairs 540 determines the amount of pressure applied to squeeze the resin material through the perforations. Too much pressure will deform the part, so the gap dimension of each roller pair 540 must be established accurately. This gap decreases from roller pair to roller pair downstream, as the resin material is squeezed further and further through the perforations. A metal belt puller could also be used in place of the laminating rollers 540. The laminating rollers 540 thus force the perforated extensions of the first and second leg members of channel member 120A together such that portions of the resin material pass through the perforations in the extensions of the leg members. In this manner, the extensions of the leg members are secured to the material such that the material forms a bridge 110A across the leg members.

The laminating rollers 540 are cooled by internally circulating cold water (approximately 10 degrees Celsius) so that the hot resin material does not stick to the rollers, and to keep the associated roller bearings cool. It is important that the cooling of the metal channel 120A does not occur until after full penetration of the molten resin material through the perforations has occurred. To limit cooling of the bottom rollers, and thus the metal channel 120A, the circulating water flow is throttled. After the insulating spacer 100A has exited the laminating rollers 540, additional cooling is applied in cooling station 550 to fully solidify the top bridge member 110A before it reaches the final pulling device. This additional cooling can be provided by any convenient way, including a water bath, air blower, free convection or equivalent method.

The preferred pulling device 560 is a rubber belt catapuller, but could also be a series of roller pairs, or the like. This puller 560 applies a gentle pull on the insulating spacer 100A, as the resin material 530 is being applied upstream. This gentle pull assures that the rollformed channel member 120A does not buckle upstream of the laminating process, where some axial compressive forces inherently result. This pulling device 560 may not be required if the laminating rollers 540 are power driven. Downstream of the pulling device 560, a conventional rollforming straightening block (not shown) can be used to straighten the insulating spacer 100A. It is important that the insulating spacer 100A is fully cooled to near ambient before straightening forces are applied; otherwise, residual stresses in the part could post-warp the part after it leaves the machine.

Openings 160A in top bridge member 110A are preferably punched at the end of the extrusion line, but can also be punched off line, or just prior to, or after application to the metal channel. A conventional rollforming cut-off device 570, such as a flying cut-off saw or shear, is used to cut the finished parts into lengths for subsequent packaging and handling.

While reference above has been made to the formation of insulating spacer 100A shown in FIG. 1A, that discussion is equally applicable to the formation of the insulating spacers shown in FIGS. 1A, 2A and 2B. A similar method is used to make insulating spacer 300A shown in FIG. 3A and insulating spacer 300B shown in FIG. 3B. In those embodiments, metal strip 500 is rollformed in rollformer 505 to form first and second leg members (321A and 324A, for example), the leg members having extensions on each end thereof. The extensions are perforated in punch station 510 in the manner discussed above. The first and second leg members are, for example, preheated near or above the melting point of one of a synthetic resin material and a composite synthetic resin material 530. Other techniques, discussed above, can be used to secure these elements together. Laminating rollers 540 force together the extensions on each end of the first and second leg members and the resin material 530, to secure the second bridge members (310A and 340A, for example), across the leg members. The laminating rollers 540 force together the extensions of the first and second leg members with the material such that portions of the material on each end of the leg members pass through the perforations in the extensions of the leg members. Thus, the material is secured to the extensions of the leg members such that the material forms first and second leg members 1310A and 340, for example, across the leg members. Insulating spacer 300A or 300B is then processed in the manner discussed above.

The embodiments discussed above are representative of embodiments of the present invention and are provided for illustrative purposes only. They do not limit the scope of the present invention. Although certain dimensions, configurations and methods of making the spacer have been shown and described, such are not limiting. Modifications and variations are contemplated within the scope of the present invention, which is intended to be limited only by the scope of the accompanying claims.

What is claimed is:

1. An insulating spacer for creating a thermally insulating bridge between spaced apart panes of a multiple pane unit, the insulating spacer comprising:

a top bridge member for contacting spaced apart panes of the multiple pane unit, the top bridge member being made of one of a synthetic resin material and a composite synthetic resin material and having an upper surface and a lower surface substantially parallel to the upper surface;

a metallic first leg member and a metallic second leg member, the first leg member and the second leg member having extensions on one end thereof, the extensions being perforated, and the perforated extensions being secured to the lower surface of the top bridge member;

a bottom bridge member substantially parallel to the top bridge member and which cooperates with each of the first and second leg members; and a channel portion defined by a configuration of the top bridge member, the first and second leg members and the bottom bridge member.

2. An insulating spacer according to claim 1, wherein portions of the top bridge member pass through the perforations in the extensions of the leg members, to secure the leg members to the top bridge member.

3. An insulating spacer according to claim 1, wherein the first leg member and the second leg member are each bent into a zig-zag configuration.

4. An insulating spacer according to claim 1, wherein the bottom bridge member is roll-formed from the same piece of metal as the first and second leg members.

5. An insulating spacer according to claim 3, wherein the bottom bridge member is roll-formed from the same piece of metal as the first and second leg members.

6. An insulating spacer according to claim 1, wherein the bottom bridge member is made of one of a synthetic resin material and a composite synthetic resin material, the first leg member and the second leg member have extensions on another end thereof opposite the one end, these extensions being perforated, and these perforated extensions being secured to the bottom bridge member.

7. An insulating spacer according to claim 3, wherein the bottom bridge member is made of one of a synthetic resin material and a composite synthetic resin material, the first leg member and the second leg member have extensions on another end thereof opposite the one end, these extensions being perforated, and these perforated extensions being secured to the bottom bridge member.

8. An insulating spacer according to claim 1, wherein the top bridge member is made of PETG.

9. An insulating spacer according to claim 6, wherein the top and bottom bridge members are made of PETG.

10. An insulating spacer according to claim 1, wherein the first and second leg members are comprised of a material selected from the group consisting of stainless steel, galvanized steel, tin plated steel and aluminum.

11. An insulating spacer according to claim 1, wherein the first and second leg members provide structural rigidity and intended bendability in fabrication and allow the spacer to conform to and retain varying dimensions and frame configurations.

12. A method of making an insulating spacer for spacing apart panes of a multiple pane unit, said method comprising the steps of:

forming metal into first and second leg members of a metallic channel, the first and second leg members having extensions on one end thereof and the extensions being perforated;

preheating the first and second leg members of the channel near or above the melting point of one of a synthetic resin material and a composite synthetic resin material;

forcing together the extensions of the first and second leg members of the channel and the one of the synthetic resin material and the composite synthetic resin material, to secure the extensions of the leg members to the material such that the material forms a first bridge member across the leg members; and defining a channel portion of an insulating spacer by a configuration of the first bridge member, the first and second leg members and a second bridge member.

13. A method according to claim 12, further comprising using laminating rollers to force the extensions of the first and second leg members together with the material.

14. A method according to claim 13, wherein the laminating rollers force the perforated extensions of the first and second leg members together with the material such that portions of the material pass through the perforations in the extensions of the leg members.

15. A method of making an insulating spacer according to claim 12, wherein the first and second leg members of the metal channel are bent into a zig-zag configuration.

16. A method of making an insulting spacer according to claim 12, wherein the second bridge member is roll-formed from the same metal as the first and second leg members.

17. A method of making an insulating spacer according to claim 15, wherein the second bridge member is roll-formed from the same metal as the first and second leg members.

18. A method of making an insulating spacer according to claim 12, wherein the second bridge member is made from one of a synthetic resin material and a composite synthetic resin material.

19. A method of making an insulating spacer according to claim 15, wherein the second bridge member is made from one of a synthetic resin material and a composite synthetic resin material.

20. A method of making an insulating spacer according to claim 12, wherein the first bridge member is made of PETG and the first and second leg members are made of a material selected from the group consisting of stainless steel, galvanized steel, tin plated steel and aluminum.

21. A method of making an insulating spacer according to claim 15, wherein the first bridge member and the second bridge member are made of PETG and the first and second leg members are made of a material selected from the group consisting of stainless steel, galvanized steel, tin plated steel and aluminum.

22. A method of making an insulating spacer having a width approximately equal to the desired space between panes in a multiple pane unit, said method comprising the steps of:

forming metal into first and second leg members, the first and second leg members having extensions on each end thereof, the extensions of the first and second leg members being perforated;

preheating the first and second leg members near or above the melting point of one of a synthetic resin material and a composite synthetic resin material; and forcing together the extensions on each end of the first and second leg members and the one of the synthetic resin material and the composite synthetic resin material, to secure the extensions of the leg members to the material such that the material forms first and second bridge members across the leg members.

23. A method of making an insulating spacer according to claim 22, further comprising using laminating rollers to force the extensions of the first and second leg members together with the material.

24. A method of making an insulating spacer according to claim 22, wherein the laminating rollers force the extensions of the first and second leg members together with the material such that portions of the material on each end of the leg members pass through the perforations in the extensions of the leg members.

25. A method of making an insulating spacer according to claim 22, wherein the first and second leg members of the metal channel are bent into a zig-zag configuration.

26. A method of making an insulating spacer according to claim 22, wherein the first and second bridge members are made of PETG and the first and second leg members are made of a material selected from stainless steel, galvanized steel, tin plated steel and aluminum.

* * * * *